US010688354B2

(12) United States Patent
Doi et al.

(10) Patent No.: US 10,688,354 B2
(45) Date of Patent: Jun. 23, 2020

(54) METHOD FOR MANUFACTURING IRON GOLF CLUB HEAD, IRON GOLF CLUB HEAD, AND IRON GOLF CLUB

(71) Applicants: Mizuno Corporation, Osaka (JP); Chuo Industries, Ltd., Hiroshima (JP)

(72) Inventors: Kazuhiro Doi, Osaka (JP); Tetsuya Kanayama, Osaka (JP); Jun Yoshikawa, Hiroshima (JP)

(73) Assignees: Mizuno Corporation, Osaka (JP); Chuo Industries, Ltd., Hiroshima (JP)

( * ) Notice: Subject to any disclaimer, the term of this patent is extended or adjusted under 35 U.S.C. 154(b) by 0 days.

(21) Appl. No.: 16/305,550

(22) PCT Filed: Mar. 27, 2018

(86) PCT No.: PCT/JP2018/012380

§ 371 (c)(1),
(2) Date: Nov. 29, 2018

(87) PCT Pub. No.: WO2018/181282

PCT Pub. Date: Oct. 4, 2018

(65) Prior Publication Data

US 2019/0358503 A1 Nov. 28, 2019

(30) Foreign Application Priority Data

Mar. 31, 2017 (JP) ..... 2017-069493
Mar. 31, 2017 (JP) ..... 2017-069494

(51) Int. Cl.
*A63B 53/04* (2015.01)
*B21K 17/00* (2006.01)

(52) U.S. Cl.
CPC ..... *A63B 53/047* (2013.01); *B21K 17/00* (2013.01)

(58) Field of Classification Search
USPC ..... 473/324–350
See application file for complete search history.

(56) References Cited

U.S. PATENT DOCUMENTS 3,825,991 A * 7/1974 Cornell ..... A63B 53/04 29/412
5,439,223 A 8/1995 Kobayashi
(Continued)

FOREIGN PATENT DOCUMENTS

CN 1500019 A 5/2004
CN 10549203 A 5/2004
(Continued)

OTHER PUBLICATIONS

International Search Report issued in related application No. PCT/JP2018/012380 dated Jun. 5, 2018.

*Primary Examiner* — Alvin A Hunter
(74) *Attorney, Agent, or Firm* — Troutman Sanders LLP; James E. Schutz; Micah B. Hensley

(57) ABSTRACT

Provided is a method for manufacturing an iron golf club head by forging a single round rod member with a pair of dies to form, as a single piece, a body and a neck into which a shaft is to be inserted. The method includes: a first step of heating the single round rod member into a heated material; a second step of placing the heated material in the pair of dies; and a third step of forging the heated material placed in the pair of dies. In the third step, the heated material is prevented from flowing out from parting surfaces of the respective dies at a sole side of the body in the pair of dies, and the heated material blocked at the sole side in the pair of dies flows toward each of a toe of the body and the neck in the pair of dies.

5 Claims, 10 Drawing Sheets

(56) References Cited

U.S. PATENT DOCUMENTS

| | | | | |
|---|---|---|---|---|
| 6,666,779 | B1 * | 12/2003 | Iwata | A63B 53/02 473/350 |
| 7,040,000 | B2 * | 5/2006 | Takeda | A63B 53/04 29/505 |
| 7,380,325 | B2 * | 6/2008 | Takeda | A63B 53/04 29/505 |
| 8,454,453 | B2 * | 6/2013 | Hettinger | A63B 53/02 473/350 |
| 8,926,451 | B2 * | 1/2015 | Deshmukh | B21K 17/00 473/349 |
| 9,387,370 | B2 * | 7/2016 | Hebreo | B21K 17/00 |
| 9,504,887 | B2 * | 11/2016 | Ines | A63B 53/047 |
| 9,616,303 | B2 * | 4/2017 | Wu | A63B 53/047 |
| 9,616,304 | B2 * | 4/2017 | Deshmukh | B21K 17/00 |
| 9,884,231 | B2 * | 2/2018 | Hebreo | A63B 53/02 |
| 10,207,162 | B2 * | 2/2019 | Deshmukh | B21K 17/00 |
| 10,220,275 | B2 * | 3/2019 | Hebreo | B21K 17/00 |
| 10,391,370 | B2 * | 8/2019 | Tassistro | B21K 17/00 |
| 10,398,951 | B2 * | 9/2019 | Golden | A63B 53/047 |
| 2004/0093926 | A1 | 5/2004 | Natsui et al. | |
| 2005/0034835 | A1 | 2/2005 | Tsai | |
| 2009/0253531 | A1 | 10/2009 | Doi et al. | |
| 2013/0137532 | A1 * | 5/2013 | Deshmukh | B21K 17/00 473/349 |
| 2013/0288823 | A1 * | 10/2013 | Hebreo | B21K 17/00 473/349 |
| 2014/0073450 | A1 * | 3/2014 | Hebreo | B21K 17/00 473/342 |

FOREIGN PATENT DOCUMENTS

| | | | |
|---|---|---|---|
| CN | 1500019 | A | 10/2009 |
| CN | 101549203 | A | 10/2009 |
| JP | H0623074 | A | 2/1994 |
| JP | 10179821 | A | 7/1998 |
| JP | H10179821 | A | 7/1998 |
| JP | 2002361354 | A | 12/2002 |
| JP | 2009261908 | A | 11/2009 |
| KR | 10-0572560 | B1 | 4/2006 |
| WO | 2002078875 | A1 | 10/2002 |

* cited by examiner

| | | COMPARATIVE EXAMPLE | EXAMPLE |
|---|---|---|---|
| ① | ■0.020Pa | 0.429 | 0.472 |
| ② | ■0.015Pa | 0.460 | 0.508 |
| ③ | ■0.010Pa | 0.564 | 0.626 |

METHOD FOR MANUFACTURING IRON GOLF CLUB HEAD, IRON GOLF CLUB HEAD, AND IRON GOLF CLUB

This application is a U.S. National Stage of International Patent Application No. PCT/JP2018/012380, filed 27 Mar. 2018, which claims the benefit of Japanese Application Nos. JP2017-069493 and JP2017-069494, filed 31 Mar. 2017. The entire contents of which are hereby incorporated in their entireties by reference herein.

TECHNICAL FIELD

The present invention relates to a method for manufacturing an iron golf club head, and to an iron golf club head and an iron golf club.

BACKGROUND ART

A known conventional iron golf club head manufactured by forging is molded so as to include grain flows extending continuously in the direction from the neck toward the toe of the face of the head. For example. Japanese Patent Laying-Open No. 2009-261908 (PTL 1) discloses an iron golf club head having grain flows extending continuously from the neck to the toe. The grain flows are distributed evenly within the face so as to provide improved feel.

CITATION LIST

Patent Literature

PTL 1: Japanese Patent Laying-Open No. 2009-261908

SUMMARY OF INVENTION

Technical Problem

In the golf club market, however, there is always a demand for more excellent feel, and the iron golf club manufactured by forging is also required to provide further improved feel.

The present invention has been made to solve the above problem, and an object of the present invention is to provide a method for manufacturing an iron golf club head in which grain flows are formed continuously so as to be able to provide further enhanced feel, and to provide the iron golf club head and an iron golf club.

Solution to Problem

In order to solve the above problem, a method for manufacturing an iron golf club head according to the present invention is a method for manufacturing an iron golf club head by forging a single round rod member with a pair of dies to form, as a single piece, a body forming a ball striking portion and a neck into which a shaft is to be inserted. The method includes a first step of heating the single round rod member into a heated material, a second step of placing the heated material in the pair of dies, and a third step of forging the heated material placed in the pair of dies. In the third step, the heated material is prevented from flowing out from parting surfaces of the respective dies at a sole side of the body in the pair of dies, and the heated material blocked at the sole side in the pair of dies flows toward each of a toe of the body and the neck in the pair of dies.

An iron golf club head and an iron golf club according to the present invention include: a body forming a ball striking portion: and a neck into which a shaft is to be inserted, and the body and the neck are formed as a single piece from a single material by forging. Grain flows extend from the neck to a toe of the body, and a ratio of the number of grain flows included in the iron golf club head to the number of grain flows included in the single material is higher than 97%.

Advantageous Effects of Invention

According to the present invention, grain flows included in the raw material can be enclosed effectively in and around a region behind the ball striking portion of the iron golf club head without cutting the grain flows. Accordingly, more excellent feel can be provided.

DESCRIPTION OF EMBODIMENTS

First Embodiment

Figure 1:
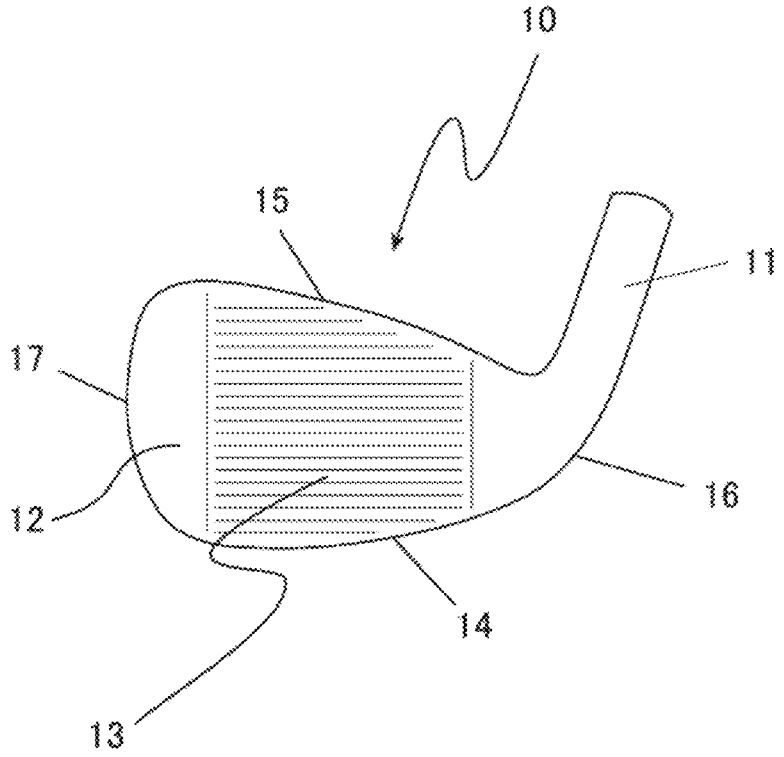
FIG. 1 is a front view of an iron golf club head according to the present invention.

FIG. 1 shows a front view of an iron golf club head 10 according to a first embodiment.

In FIG. 1, iron golf club head 10 (hereinafter also referred to as "head 10" as appropriate) is made up of a neck 11 to which a shaft is to be connected, and a body 12 forming a ball striking portion. Body 12 has a face 13 forming a ball striking surface, a sole 14 forming a bottom portion of head 10, a top edge 15 forming an upper edge portion of head 10, a heel 16 connecting the lower end of neck 11 to sole 14, and a toe 17 located opposite to heel 16 and connecting sole 14 to top edge 15.

Figure 2:
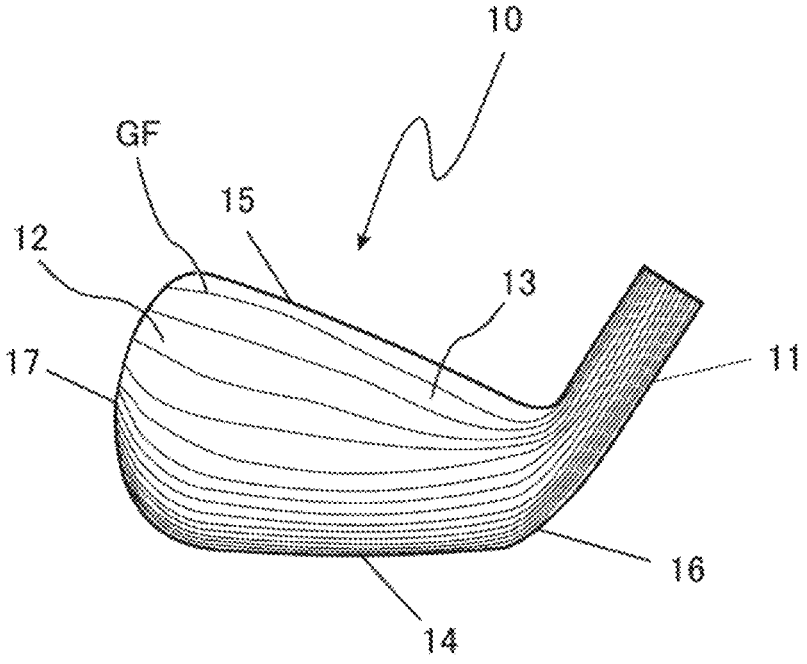
FIG. 2 schematically shows streams of grain flows of an iron golf club head according to the present invention.

Regarding head 10, neck 11 and body 12 are formed as a single piece from a single material by forging. Grain flows GF are formed in the surface and the inside of head 10. FIG. 2 schematically shows a distribution of grain flows GF extending in the surface and the inside of head 10. FIG. 2 shows a state of head 10 as seen from the face 13 side. In FIG. 2, all the solid lines shown inside head 10 represent grain flows GF, and only one grain flow is indicated by a reference character for the sake of convenience.

In FIG. 2, grain flows GF of head 10 of the present invention extend continuously from neck 11 to toe 17. In a sole 14 side, grain flows GF extend from neck 11 to toe 17 through heel 16 and sole 14 along the shape of the outer edge of head 10, and finally terminate at toe 17. In particular, grain flows GF extending from neck 11 to sole 14 further extend continuously in a region connecting sole 14 to toe 17. In this region, grain flows GF are curved upward toward toe 17.

Since grain flows OF extend along the shape of the outer edge of head 10, the length of grain flows GF in the sole 14 side is longer as compared with a conventional head in which grain flows extend linearly along the sole. For example, a score line is used herein as a reference length. Length Lt of grain flow GF is defined herein as a length (distance) from the heel 16 side end of the score line to the toe 17 side end of head 10. Then, the sole 14 side includes at least a grain flow GF having a length more than or equal to 1.30 times and less than or equal to 1.35 times as long as length Ls of the score line. Such grain flow GF in the sole 14 side can be identified at least in a range of one-fourth from the sole end on a score line center defined herein as extending on head 10.

As to the number of grain flows GF, the ratio of the number of grain flows included in head 10 of the present invention to the number of grain flows included in a steel material as a raw material for the head is 97% or more, for example. The density per unit area of grain flows extending in the sole 14 side in head 10 of the present invention is higher than the density per unit area of grain flows extending in a top edge side. Details of the distribution of these grain flows OF are described later herein.

Next, a method for manufacturing head 10 of the present invention is described with reference to FIGS. 3 to 9.

Figure 3:
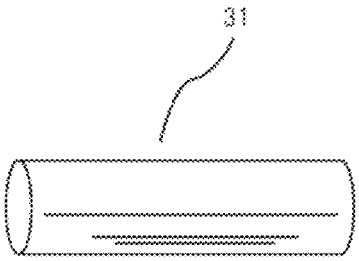
FIG. 3 shows a raw material for an iron golf club head according to the present invention.

In a first step as shown in FIG. 3, a round rod member 31 of carbon steel or the like is prepared. The diameter of round rod member 31 is approximately 25 mm to 28 mm, for example. Next, in a second step, round rod member 31 is heated at a temperature of 1000° C. or more.

Figure 4:
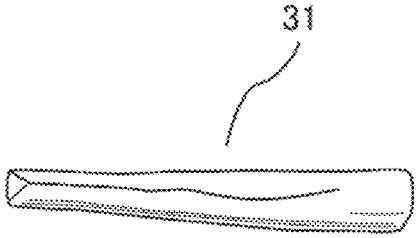
FIG. 4 illustrates a step for manufacturing an iron golf club head according to the present invention.

Next, in a third step, one end of round rod member 31 undergoes drawing so as to be reduced in cross-sectional area. For this drawing, rolls are used for example to perform rolling on the one end of round rod member 31. FIG. 4 shows round rod member 31 after the drawing. In this way, the one end of round rod member 31 having undergone the drawing is formed into neck 11 and the other end thereof is formed into body 12. Accordingly, the density of grain flows GF in neck 11 can be made higher than the density of grain flows GF in body 12. Any process other than rolling can be used as long as the process can plastically deform one end of round rod member 31 to thereby reduce the cross-sectional area of round rod member 31. The third step may be skipped.

Figure 5:
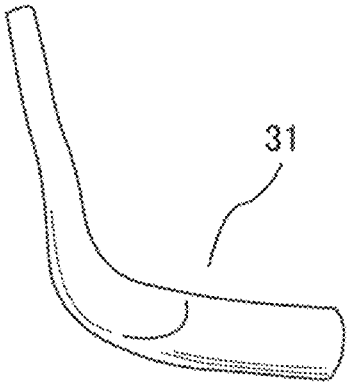
FIG. 5 illustrates a step for manufacturing an iron golf club head according to the present invention.
Figure 6:
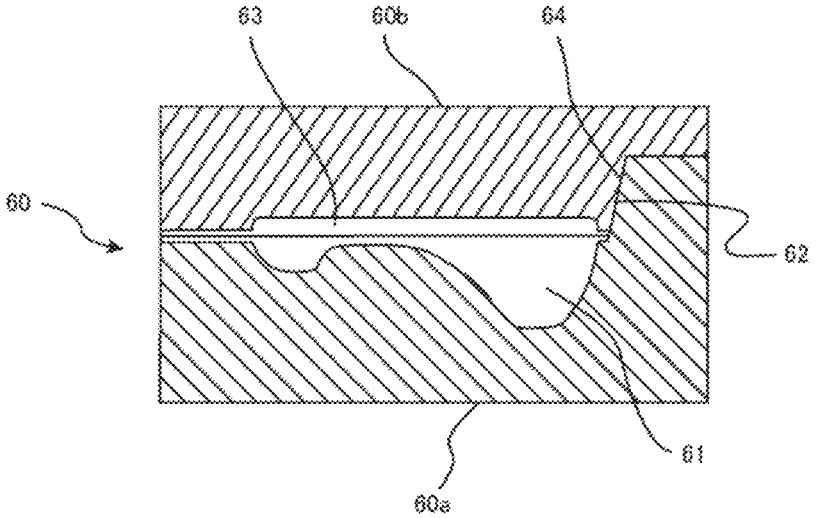
FIG. 6 is a schematic cross-sectional view of a die to be used for manufacturing an iron golf club head according to the present invention.
Figure 7:
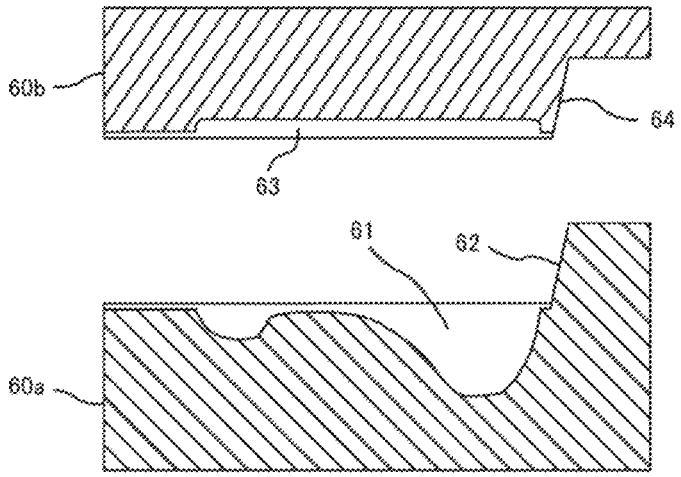
FIG. 7 is a schematic cross sectional view of the die to be used for manufacturing an iron golf club head according to the present invention.
Figure 8:
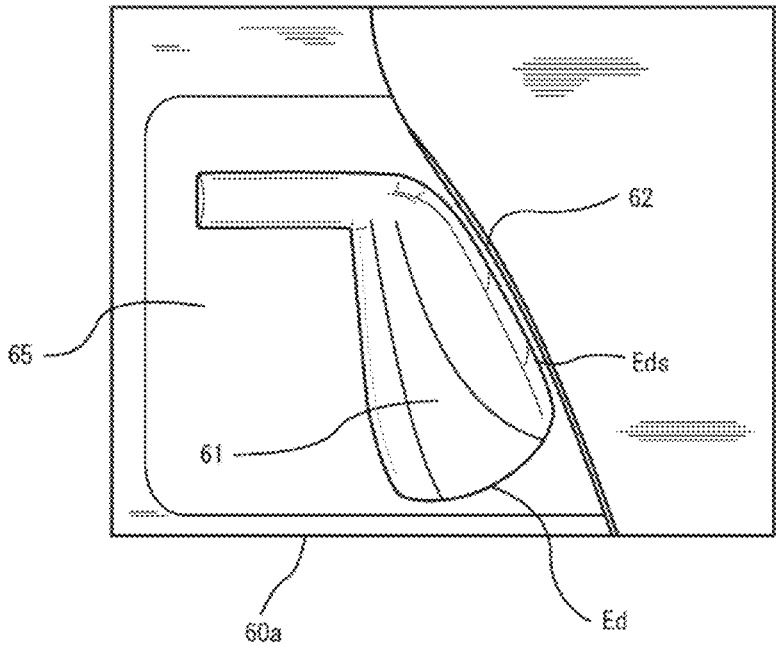
FIG. 8 is a schematic plan view of a lower die of the die to be used for manufacturing an iron golf club head according to the present invention.

Next, in a fourth step as shown in FIG. 5, round rod member 31 undergoes bending. After this, in a fifth step, round rod member 31 having undergone bending is set in a die to undergo primary forging. FIGS. 6 and 7 are each a partial schematic cross-sectional view of a die 60 to be used for primary forging of head 10. FIG. 6 shows a state in which a lower die 60*a* and an upper die 60*b* are closed, and FIG. 7 shows a state in which lower die 60*a* and upper die 60*b* are separated from each other. FIG. 8 is a schematic plan view of lower die 60*a*.

In FIGS. 6 to 8, a first depressed portion 61 corresponding to the shape of the back side of head 10 is formed in lower die 60*a*. Around first depressed portion 61, in a region other than the portion corresponding to sole 14, a flash reservoir 65 is formed to allow extra material of round rod member 31 to be released into this reservoir 65. As shown in FIG. 8, on the parting surface of lower die 60*a*, an edge Ed of first depressed portion 61 corresponding to the contour of head 10 appears. On the parting surface of lower die 60*a*, along an edge Eds corresponding to sole 14 of head 10, a closing wall 62 rises, where edge Eds is a part of edge Ed. In the horizontal direction, closing wall 62 is located at a position displaced by an offset of approximately 2 mm to 5 mm for example from edge Eds corresponding to sole 14. From this position, closing wall 62 rises. In the vertical direction, closing wall 62 rises to extend at least longer than the offset from edge Eds in the horizontal direction.

In upper die 60*b* as shown in FIGS. 6 and 7, a second depressed portion 63 corresponding to the shape of the face side of head 10 and a closing-wall abutting surface 64 having a shape complementary to closing wall 62 of lower die 60*a* are formed. Around second depressed portion 63, in a region other than the portion corresponding to sole 14, a flash reservoir 65 is formed to allow extra material of round rod member 31 to be released into flash reservoir 65. Closing-wall abutting surface 64 forms a shape of a step in the parting surface of upper die 60*b*. Between closing wall 62 and closing-wall abutting surface 64, there may be a clearance in the state where lower die 60*a* and upper die 60*b* are closed.

During the primary forging in the fifth step, the bent round rod member 31 is set in above-described depressed portion 61 of lower die 60*a* and upper die 60*b* is struck with a hammer so as to plastically deform round rod member 31 in a stepwise manner. In the first embodiment, a 1-ton hammer is used to deform round rod member 31 into a shape which is close to its final shape through a three-step primary forging process.

Figure 9:
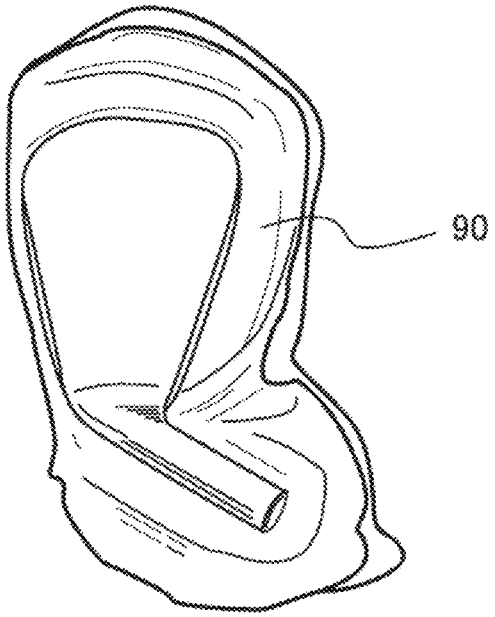
FIG. 9 shows a forged product with flash according to the present invention.

FIG. 9 shows a forged product with flash 90 after the primary forging is completed. Since die 60 has closing wall 62 and closing-wall abutting surface 64 on the sole 14 side, the material on the sole 14 side of the forged product in the forging process does not flow out as flash but is enclosed within the forged product. Therefore, as shown in FIG. 9, on the sole 14 side, less flash is generated as compared with the top edge 15 side.

After the fifth step, a sixth step is performed to trim forged product with flash 90 so as to remove the flash. After this, precision forging is performed as a final finishing process to form details such as score lines. Through these steps, head 10 can be obtained in which face 13 and neck 11 are formed as a single piece while substantially perfect grain flows GF are maintained. Then, a shall can be attached to head 10 to provide an iron golf club.

Next, characteristics of grain flows GF of head 10 manufactured in the above-described manner are described.

As described above, in head 10 of the present invention, grain flows GF extend continuously from neck 11 to toe 17. Particularly in the sole 14 side, grain flows GF are formed in a curved shape from sole 14 to the toe 17 along the shape of the outer edge of the head. Die 60 for head 10 of the present invention has closing wall 62 on the sole 14 side. If a die has no closing wall 62, namely the parting surfaces of the die are defined in a single plane, some material flows out as flash (hereinafter referred to as "ordinary mold"). In contrast, such material is enclosed in first depressed portion 61 and second depressed portion 63 of die 60. Thus, in the forged product during forging, the heated material blocked in the sole 14 side region flows in first depressed portion 61 and second depressed portion 63 from the region corresponding to the sole to the region corresponding to the toe and also to the region corresponding to neck 11 along these regions. Further, on the toe 17 side, the heated material flows in a curved shape from sole 14 toward top edge 15 along the contour of head 10. Accordingly, grain flows GF extending from neck 11 to sole 14 further extend in a curved shape from sole 14 to toe 17 toward top edge 15.

Figure 10:
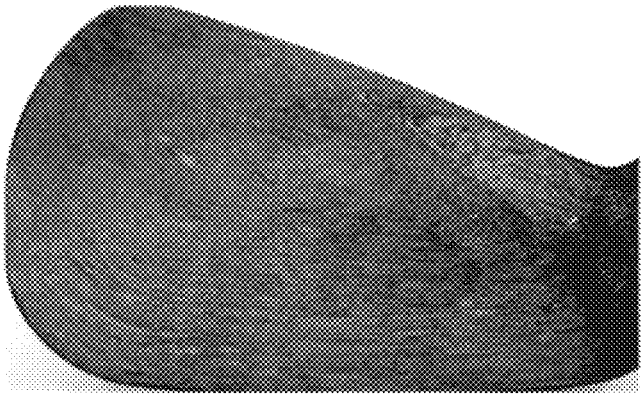
FIG. 10 is a photograph of a front side for illustrating a state of grain flows of an iron golf club head according to the present invention.
Figure 11:
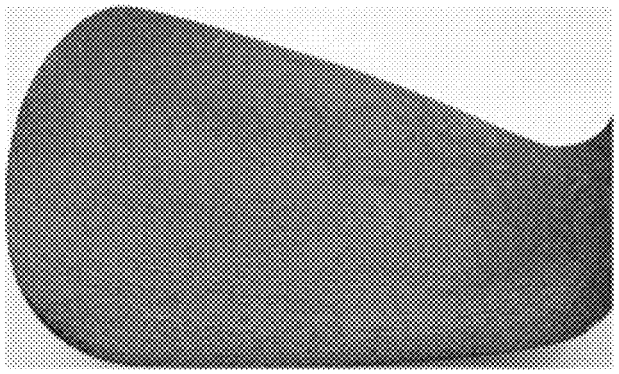
FIG. 11 is a photograph of a front side for illustrating a state of grain flows of an iron golf club head produced with an ordinary die.

FIG. 10 is a photograph of face 13 of head 10 obtained by etching head 10 having undergone the forging process in the fourth step. As shown in FIG. 10, in head 10 of the present invention, grain flows GF can be identified as extending from sole 14 to toe 17 along the shape of the outer edge of head 10. Particularly in and around the region connecting sole 14 to toe 17, grain flows GF curved upward along the contour of head 10 can be identified. In contrast, FIG. 11 is a photograph of the face side of a head forged with an ordinary die and thereafter etched. As shown in FIG. 11, in the head produced by means of the ordinary die, grain flows GF are formed linearly without curved from the sole to the toe.

From a comparison between FIG. 10 and FIG. 11, it is seen that the length of grain flows GF in the sole 14 side of head 10 of the present invention is longer than that of the head produced by means of the ordinary die. Specifically, head 10 encloses grain flows included in the original round rod without cutting the grain flows.

The inventors of the present invention measured the length of grain flows GF extending in the sole 14 side of head 10, using head 10 shown in FIG. 10. They also measured the length of grain flows extending in the sole side of the head in FIG. 11 manufactured by means of the ordinary die. The length of grain flows GF was measured in the following manner. For head 10 in FIG. 10 and the head in FIG. 11, a score line is defined herein as a score line of 56 mm in the toe-to-heel direction. Length Lt of grain flows GF was measured as a distance from the heel 16 side end of the score line to the toe 17 side end of head 10. As to the score line of respective heads in FIGS. 10 and 11, it is supposed that each of respective heads in FIGS. 10 and 11 is placed on a horizontal surface at a predetermined lie angle and the score lines extend in parallel to the horizontal surface and have a length of 56 mm from the position located 18 mm away from the endmost point of toe 17 toward the heel.

Among the identified grain flows GF extending to toe 17 in head 10 of the present invention, the shortest grain flow had a length Lt of 72.0 mm and the longest grain flow had a length Lt of 75.9 mm. It is seen from the foregoing that the sole 14 side of head 10 includes at least grain flow GF satisfying $1.30Ls<Lt<1.35Ls$, where Ls is the length of the score line in the toe-heel direction used herein as a reference. In contrast, in the head of FIG. 11 manufactured by means of the ordinary die, the shortest grain flow had a length Lt of 67.6 mm and the longest grain now had a length Lt of 72.1 mm. Length Lt of grain flow GF may be measured based on the results of a forging simulation described below.

Next, a distribution of grain flows GF of head 10 of the present invention is described.

Regarding head 10 of the present invention, grain flows GF, which would be included in the material flowing out as flash if the ordinary die is used, are enclosed in the sole 14 side of head 10. Therefore, the density per unit area of grain flows GF extending in the sole 14 side is higher than that in the head forged with the ordinary die. The inventors identified a state of distribution of grain flows GF in head 10 by conducting a forging simulation using software "FORGE" produced by TRANSVALOR.

Figure 12:
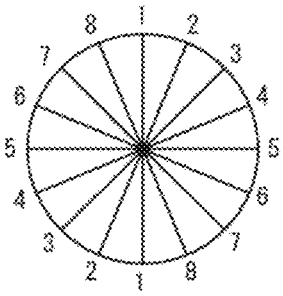
FIG. 12 illustrates a forging simulation.
Figure 13:
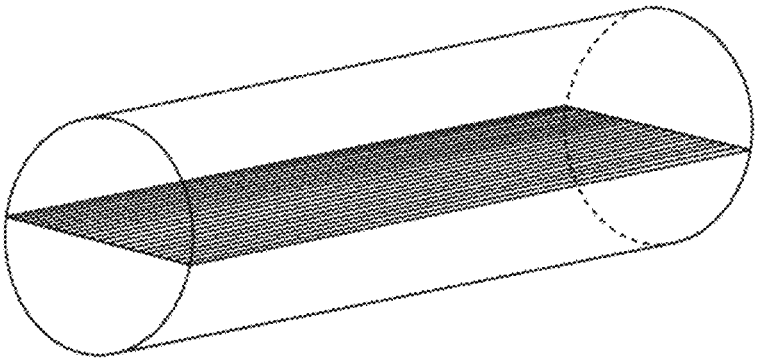
FIG. 13 illustrates the forging simulation.

The forging simulation was performed in the following way. First, in an Example of the present invention, as shown in FIG. 12, a round rod A having a diameter of 27 mm and a length of 200 mm was split radially into 16 equal pieces to prepare eight split surfaces. The eight split surfaces are cross-sectional surfaces of which a surface perpendicular to the die surface on which a workpieces is to be placed is defined as split surface A1, and the surfaces following split surface A1 in the clockwise direction are defined successively as split surfaces A2 to A8. In each of the prepared split surfaces A1 to A8, 20 grain flows in the longitudinal direction were arranged at regular intervals. FIG. 13 shows split surface A5 in which 20 grain flows are arranged. In round rod A, 160 grain flows are arranged in total in split surfaces A1 to A8. This round rod A was used as a raw material, and the forging simulation was performed using die 60 of the first embodiment to identify streams of the 20 grain flows arranged in each of split surfaces A1 to A4. The forging simulation was performed under the conditions that both the upper die and the lower die were rigid bodies and deformation in an elastic region was not taken into consideration.

Figure 14:
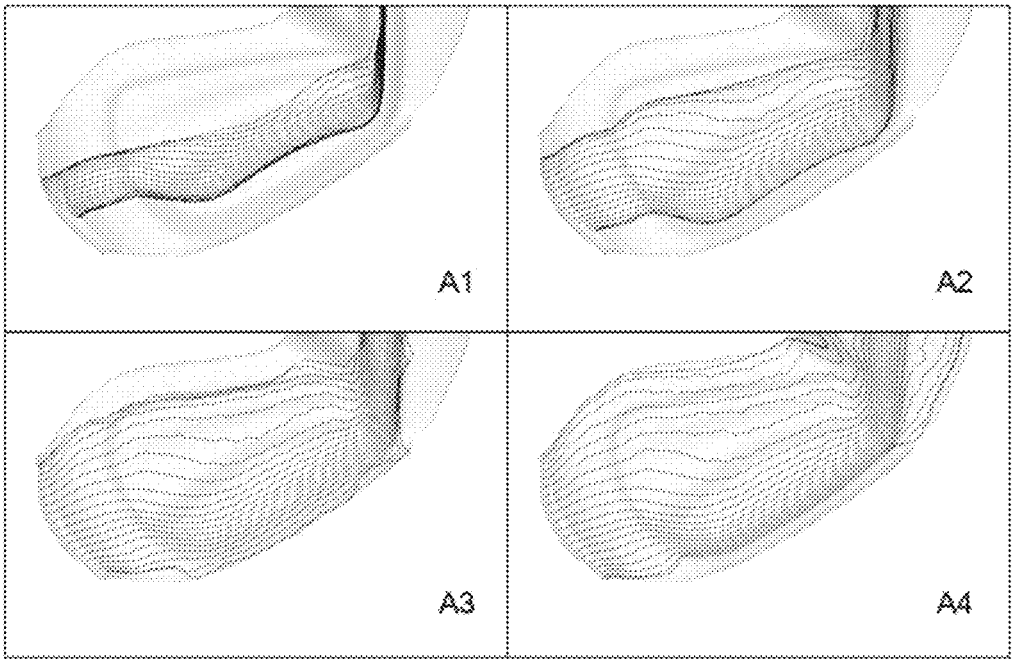
FIG. 14 illustrates results of the forging simulation according to the present invention.
Figure 15:
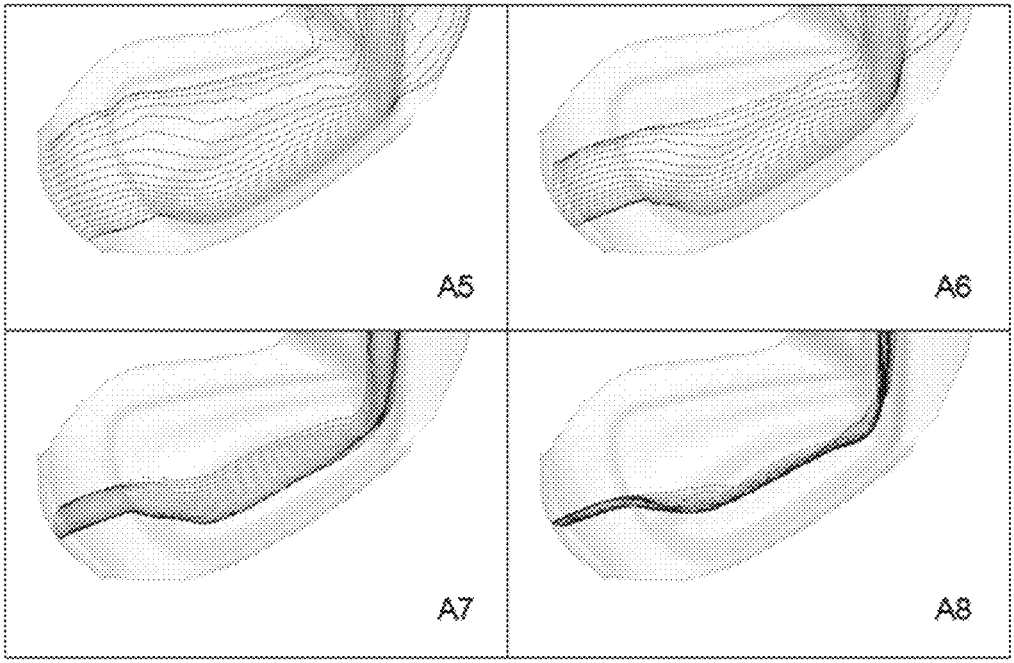
FIG. 15 illustrates results of the forging simulation according to the present invention.

FIG. 14 shows simulation results exhibiting streams of the grain flows in split surfaces A1 to A4, and FIG. 15 shows simulation results regarding split surfaces A5 to A8. In FIGS. 14 and 15, streams of the grain flows can be identified on the forged product with flash produced in the simulation.

Figure 16:
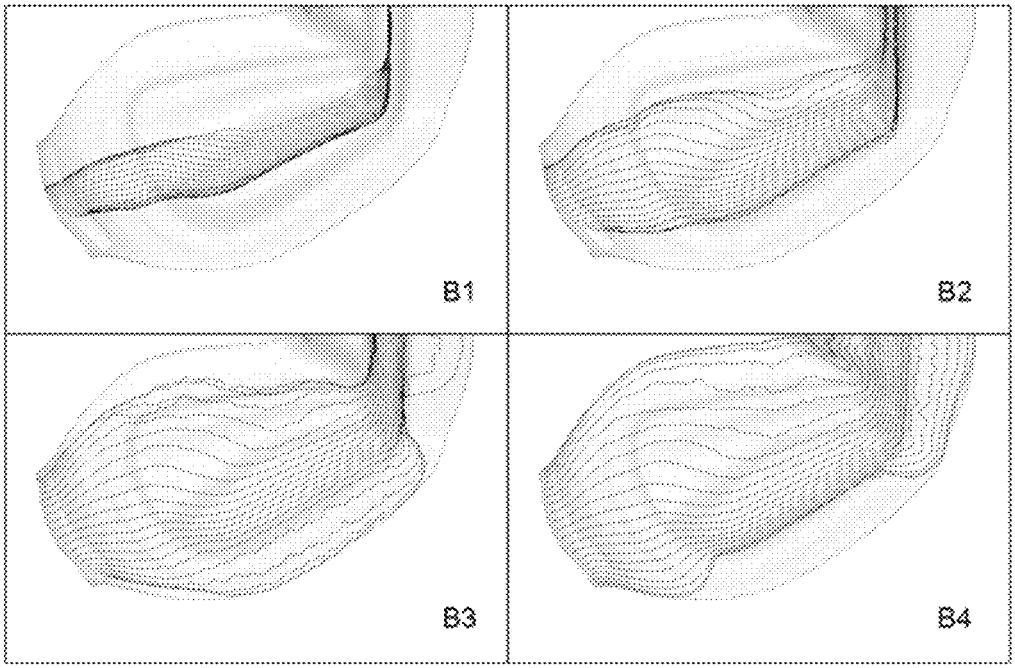
FIG. 16 illustrates results of the forging simulation according to a Comparative Example.
Figure 17:
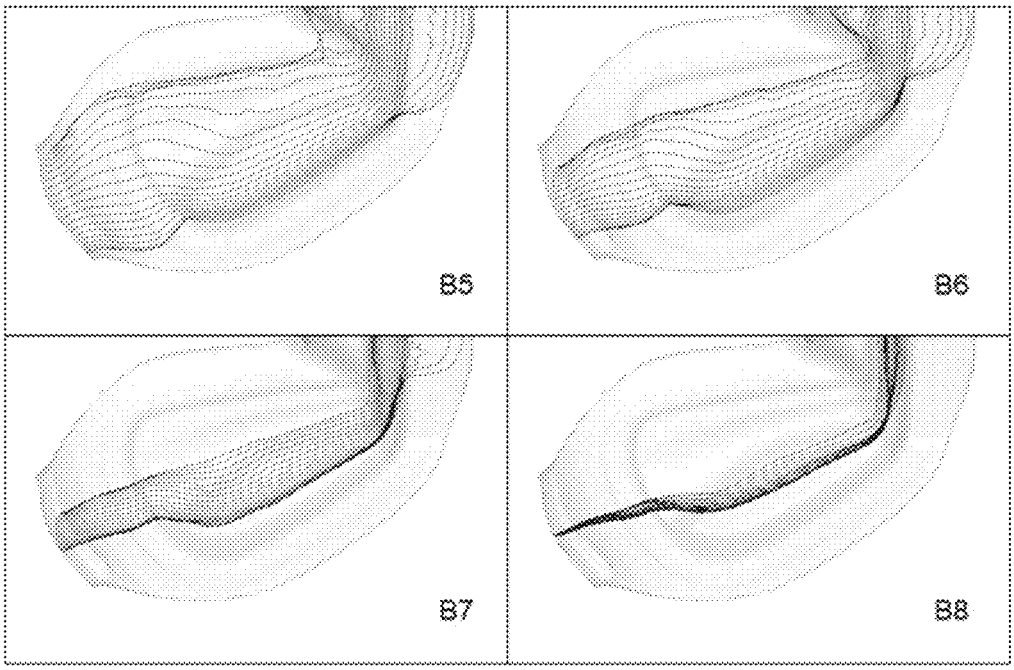
FIG. 17 illustrates results of the forging simulation according to the Comparative Example.

In a Comparative Example, a round rod B having a diameter of 27 mm and a length of 200 mm was split into 16 pieces and 20 grain flows were arranged in each of the resultant eight split surfaces (B1 to B8), similarly to the above-described Example. Then, round rod B was used as a row material, and a forging simulation was performed using the ordinary die to identify streams of the 20 grain flows arranged in each of split surfaces B1 to B8. FIG. 16 shows simulation results regarding split surfaces 131 to 34 in the Comparative Example, and FIG. 17 shows simulation results regarding split surfaces B5 to B8.

Based on the results of the forging simulation as described above, the grain flows in the Example and the Comparative Example were identified in the following way. First, according to the simulation results regarding each of split surfaces A1 to A4 and split surfaces B1 to B8, the region of the head body and the region of flash were defined in the forged product with flash. Next, a score line center was defined in the head body. On the score line center, the central point was defined as a boundary. With this central point in between, the upper side was defined as "head top side" and the lower side was defined as "head sole side." Then, the number of grain flows crossing the score line center in each of the head top side and the head sole side was counted. Moreover, in each of the flash generated in the top edge side (top side flash) and the flash generated in the sole side (sole side flash), the number of grain flows crossing an extension of the score line center was counted as grain flows included in the flash.

Table 1 shows the number of identified grain flows in each of respective regions of the top side flash, the head top side the head sole side, and the sole side flash in each of split surfaces A1 to A8 and split surfaces B1 to B8. In Table 1, "ratio 1" is the ratio of the number of grain flows in each region to the total number of grain flows (160 grain flows) arranged in each of round rods A and B. "in-head total" is the number of grain flows identified within the head (head top side|head sole side), and "ratio 2" is the ratio of the number of grain flows within the head to the total number of grain flows (160 grain flows) arranged in each of round rods A and B.

TABLE 1

| | Example (closed die) | | | | | Comparative Example (ordinary die) | | | |
|---|---|---|---|---|---|---|---|---|---|
| | top side flash | head top side | head sole side | sole side flash | | top flash | head top side | head sole side | sole flash |
| A1 | 0 | 0 | 20 | 0 | B1 | 0 | 0 | 20 | 0 |
| A2 | 0 | 4 | 16 | 0 | B2 | 0 | 3 | 17 | 0 |
| A3 | 0 | 6 | 13 | 1 | B3 | 1 | 4 | 11 | 4 |
| A4 | 3 | 3 | 14 | 0 | B4 | 4 | 2 | 14 | 0 |
| A5 | 0 | 5 | 15 | 0 | B5 | 1 | 5 | 14 | 0 |
| A6 | 0 | 3 | 17 | 0 | B6 | 0 | 5 | 15 | 0 |
| A7 | 0 | 0 | 20 | 0 | B7 | 0 | 3 | 17 | 0 |
| A8 | 0 | 0 | 20 | 0 | B8 | 0 | 0 | 20 | 0 |
| total | 3 | 21 | 135 | 1 | total | 6 | 22 | 128 | 4 |
| ratio 1 | 1.9% | 13.1% | 84.4% | 0.6% | ratio 1 | 3.8% | 13.8% | 80.0% | 2.5% |
| in-head total | — | 156 | | — | in-head total | — | 150 | | — |
| ratio 2 | — | 97.5% | | — | ratio 2 | — | 93.8% | | — |

As seen from Table 1, the ratio (ratio 2) of the number of grain flows within the head body to the number of grain flows included in the round rod is 97.5% in the Example, while this ratio is 93.8% in the Comparative Example. Thus, the head body of the Example can enclose a greater number of grain flows originally included in the round rod that is larger by 3.7% relative to the Comparative Example.

As to the ratio (ratio 1) of the number of grain flows included in the head top side, the difference between the Example and the Comparative Example is only 0.7% There is almost no difference in distribution of grain flows between the Example and the Comparative Example. The ratio of the number of grain flows included in the head sole side in the Example is 84.4% while that in the Comparative Example is 80.0%. Thus, the sole side in the Example can enclose the grain flows larger in number by 4.4% relative to that in the Comparative Example. In other words, in a cross section in the top edge-sole direction, the density per unit area of grain flows in the sole side in the Example is higher than the density per unit area of grain flows in the top edge side, as compared with the Comparative Example.

The characteristics of the distribution of grain flows of the present invention can also be identified in an actual head produced in each of the Example and Comparative Example. The inventors of the present invention prepared respective heads of the Example and the Comparative Example, cut each head in the toe-heel direction along the second score line from the sole side, and identified the grain flows appearing on the resultant cross section in each of the Example and the Comparative Example.

Figure 18:
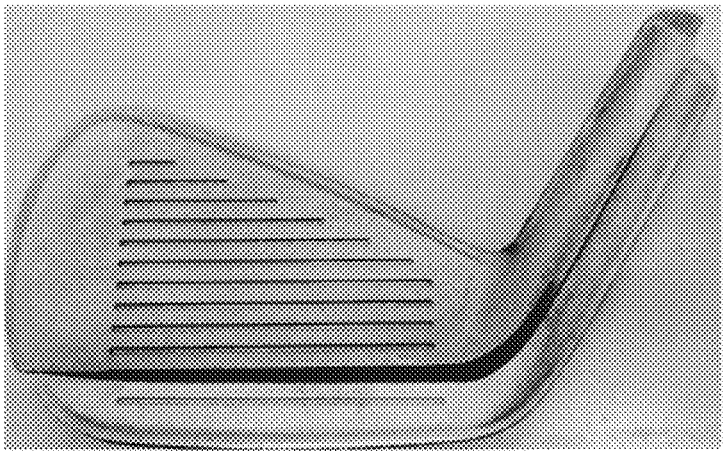
FIG. 18 is a photograph of a front side for illustrating where the head is cut.
Figure 19:
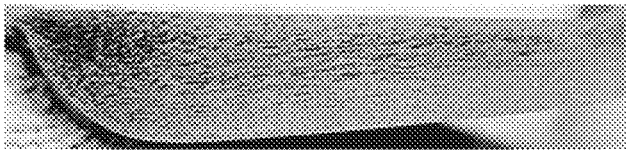
FIG. 19 is a photograph of a cross section of an upper portion of an iron golf club head according to the present invention.
Figure 20:
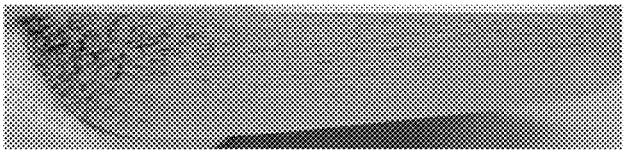
FIG. 20 is a photograph of a cross section of an upper portion of an iron golf club head according to the Comparative Example.

FIG. 18 is a photograph of the front side of the head in the Example and the Comparative Example each, showing where the head was cut. FIGS. 19 and 20 are each a photograph of a cross section of the top edge side (upper side) obtained by cutting the head in the Example and the Comparative Example. In FIGS. 19 and 20, the denser portions represent the location of grain flows.

From a comparison between FIGS. 19 and 20, it is seen that the grain flows in the Example are denser in both the face-back direction and the toe-heel direction relative to the Comparative Example. Using score lines as a reference, this characteristic can be identified within a range to the second score line from the bottom. In other words, this characteristic can be identified within a range of at least one-fourth from the sole.

Thus, according to the present invention, a greater number of grain flows originally included in the round rod as a raw material can be enclosed without cutting the grain flows. In particular, flash is prevented from flowing out from the sole side, and therefore, a greater number of grain flows extending continuously from the neck to the toe can be enclosed in and around the region behind the ball striking portion. Accordingly, the duration of the ball hitting sound can be increased and thereby more excellent feel can be provided, as described in the following.

Next, advantageous effects of head 10 formed in the above-described manner are described.

According to the findings of the inventors, some players are known to feel that the longer the duration of the ball hitting sound, the better the feel while the shorter the duration of the ball hitting sound, the worse the feel. In view of this, the advantageous effects of the present invention were confirmed by comparing respective iron golf club heads of the Example and the Comparative Example in terms of the duration of the ball hitting sound. The duration of the ball hitting sound was measured in the following way.

In a laboratory, a golf club head was placed on a sponge, a hammer was used to hit a point between the third and fourth score lines from the sole side, and the generated sound was recorded. TASCAM HD-P2 was used as a measurement instrument. Bruel & Kjar Sound Quality Type 7698 was used as software. Bruel & Kjar Microphone Type 4190 was used as a microphone. Bruel & Kjar Microphone Type 2804 was used as a power supply for the microphone. Bruel & Kjar Sound Level Calibrator Type 4231 was used as a calibrator. The distance between the hitting point and the microphone was 20 cm. The measurement time was −0.2 to 1.8 seconds. In other words, the measurement time was from 0.2 seconds before impact to 1.8 seconds after impact. The window function was "rectangular." The duration of the hitting sound was evaluated based on the time when the last low sound pressure wave appeared. Specifically, the time when the sound pressure finally became lower than each of 0.010 Pa, 0.015 Pa, and 0.020 Pa was detected. It was determined that the later the detected time, the longer the duration.

Figure 21:
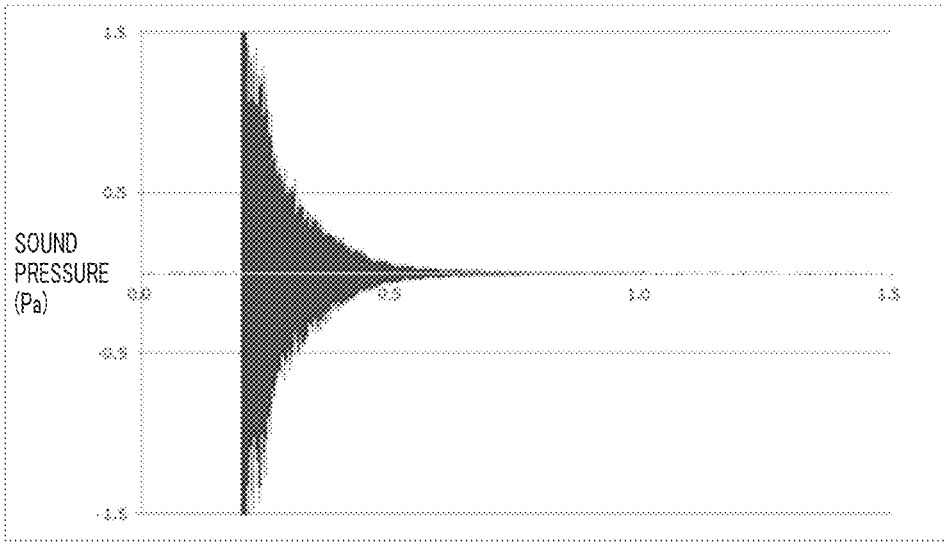
FIG. 21 is a waveform diagram showing results of measurement of the sound duration of an iron golf club head according to the present invention.
Figure 22:
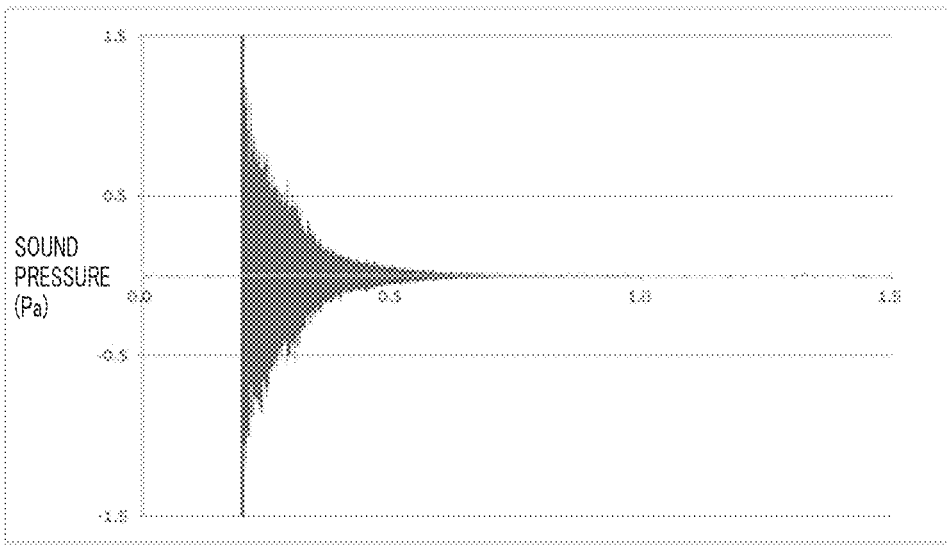
FIG. 22 is a waveform diagram showing results of measurement of the sound duration of an iron golf club head according to a Comparative Example.
Figure 23:
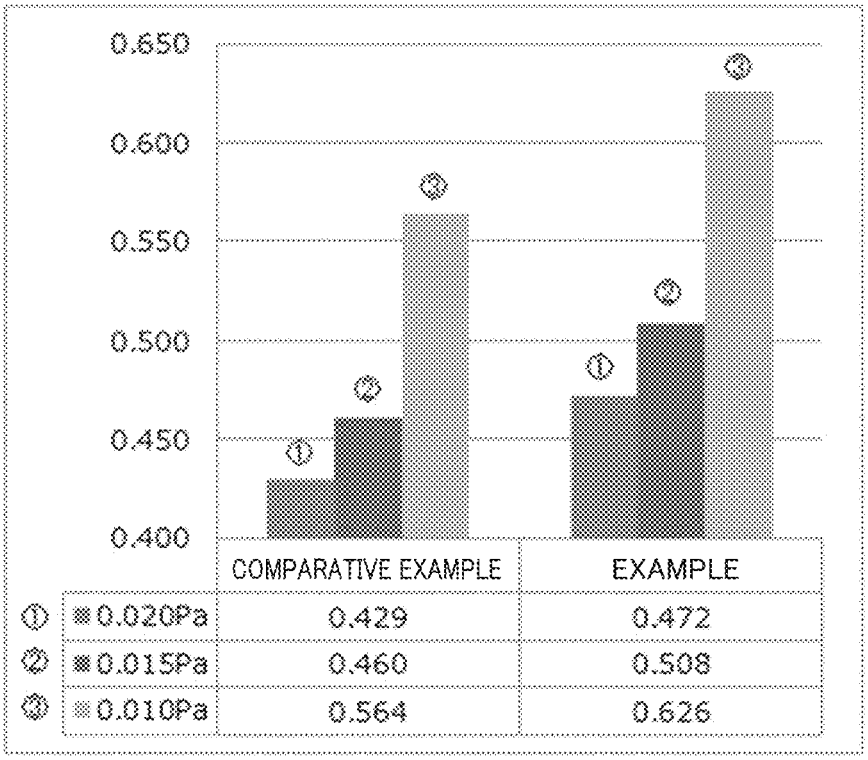
FIG. 23 is a graph for illustrating advantageous effects of the present invention.

FIGS. 21 and 22 are respective waveform diagrams showing results of measurement of the sound duration in the Example and the Comparative Example, respectively. The vertical axis represents sound pressure (Pa) and the horizontal axis represents time (seconds). Based on FIGS. 21 and 22, the time when the sound pressure finally became lower than each of 0.010 Pa, 0.015 Pa, and 0.020 Pa in the Example and the Comparative Example was calculated. FIG. 23 shows the results of the calculation. In FIG. 23, the vertical axis of the graph represents time.

It is seen from FIG. 23 that the time when the sound pressure finally became lower than 0.010 Pa 0.015 Pa and 0.020 Pa in the Example is later than that in the Comparative Example. In other words, the duration of the hitting sound of the present invention is longer than that of the Comparative Example and the present invention can provide excellent feel.

INDUSTRIAL APPLICABILITY

The present invention is useful in that it can provide an iron golf club head and an iron golf club providing excellent feel.

REFERENCE SIGNS LIST

10 iron golf club head; 11 neck; 12 body; 13 face; 14 sole; 15 top edge; 16 heel; 17 toe; 31 round rod member; 60 die; 60*a* lower die; 60*b* upper die; 61 first depressed portion; 62 closing wall; 63 depressed portion; 64 closing-wall abutting surface; 65 flash reservoir

The invention claimed is:

1. A method for manufacturing an iron golf club head by forging a single round rod member with a pair of dies to form, as a single piece, a body forming a ball striking portion and a neck into which a shaft is to be inserted, the method comprising:

a first step of heating the single round rod member into a heated material;

a second step of placing the heated material in the pair of dies; and a third step of forging the heated material placed in the pair of dies, wherein in the third step, the heated material is prevented from flowing out from parting surfaces of the respective dies at a sole side of the body in the pair of dies, and the heated material blocked at the sole side in the pair of dies flows toward each of a toe of the body and the neck in the pair of dies.

2. The method for manufacturing an iron golf club head according to claim 1, wherein the heated material blocked at the sole side in the pair of dies is caused to flow in a curved shape from the sole side to the toe in the pair of dies along a contour of the body in the pair of dies.

3. The method for manufacturing an iron golf club head according to claim 2, wherein the forging is performed with a first die including:

a first depressed portion for forming respective back sides of the body and the neck; and a closing wall rising along a region corresponding to the sole of the body in the first depressed portion, and a second die including:

a second depressed portion for forming respective face sides of the body and the neck; and a closing wall abutting surface forming a shape of a step in a parting surface of the second die and having a shape complementary to the closing wall.

4. The method for manufacturing an iron golf club head according to claim 3, wherein the forging is performed by hammer forging.

5. A method for manufacturing an iron golf club head by forging a single round rod member with a pair of dies to form, as a single piece, a body forming a ball striking portion and a neck into which a shaft is to be inserted, the method comprising:

a first step of heating the single round rod member into a heated material;

a second step of placing the heated material in the pair of dies;

a third step of forging the heated material placed in the pair of dies, wherein in the third step, the heated material is prevented from flowing out from parting surfaces of the respective dies at a sole side of the body in the pair of dies, and the heated material blocked at the sole side in the pair of dies flows toward each of a toe of the body and the neck in the pair of dies;

wherein the heated material blocked at the sole side in the pair of dies is caused to flow in a curved shape from the sole side to the toe in the pair of dies along a contour of the body in the pair of dies;

wherein the forging is performed with a first die including:

a first depressed portion for forming respective back sides of the body and the neck; and a closing wall rising along a region corresponding to the sole of the body in the first depressed portion, and a second die including:

a second depressed portion for forming respective face sides of the body and the neck; and a closing wall abutting surface forming a shape of a step in a parting surface of the second die and having a shape complementary to the closing wall;

wherein the forging is performed by hammer forging; and wherein the method further comprises, after the first step:

a drawing step of making one end of the heated material smaller in diameter than the other end of the heated material; and a step of bending the heated material after the drawing step, and the heated material after undergoing the bending step is placed in the pair of dies and the forging is performed on the heated material.

* * * * *